United States Patent [19]

Lee

[11] Patent Number: 4,878,592

[45] Date of Patent: Nov. 7, 1989

[54] APPARATUS FOR SEGREGATED REFUSE COLLECTION

[75] Inventor: Norman C. Lee, Greensboro, N.C.

[73] Assignee: Zarn, Inc., Reidsville, N.C.

[21] Appl. No.: 212,609

[22] Filed: Jun. 28, 1988

[51] Int. Cl.[4] ..... B65D 91/00

[52] U.S. Cl. ..... 220/23.83; 220/1 T; 220/408

[58] Field of Search ..... 220/23.83, 23.84, 1 T, 220/408

[56] References Cited

U.S. PATENT DOCUMENTS

| | | | |
|---|---|---|---|
| 617,445 | 1/1899 | Nathan | 220/408 |
| 3,402,848 | 9/1968 | Busey | 220/1 T X |
| 3,720,346 | 3/1973 | Cypher | 220/1 T X |
| 3,856,173 | 12/1974 | Deane et al. | 220/23.83 X |
| 3,904,218 | 9/1975 | Kostic | 220/1 T X |
| 3,971,360 | 7/1976 | Spoeth, Jr. | 220/408 X |
| 4,739,894 | 4/1988 | Pender | 220/1 T |

*Primary Examiner*—Steven M. Pollard

*Attorney, Agent, or Firm*—Shefte, Pinckney & Sawyer

[57] ABSTRACT

A refuse collection apparatus for segregation of recyclable materials and the like includes an outer container body which receives a plurality of inner complimentary receptacle units. Each receptacle unit includes recessed handle members at the upper edge thereof to facilitate removal from the outer container and a lower handle portion at the opposite end of the unit for convenient carrying and dumping of the unit. In one embodiment, a wire support frame is fitted within the rim of the outer container body to support lip portions of the receptacle units. In another embodiment, a receptacle tray is provided to rest within the container body on the receptacle units for collecting stackable recyclable materials such as newspaper, while only partially covering the access openings to the receptacle units for permitting deposit of refuse therein without removing the tray. In a third embodiment a partition wall divides the interior container area into two collection chambers, one being provided with receptacle units and a tray for segregated recyclable collection while the other is utilizable for non-recyclable collection. A pivoted cover for the recyclable chamber enables automated inversion and dumping of the other chamber.

21 Claims, 7 Drawing Sheets

APPARATUS FOR SEGREGATED REFUSE COLLECTION

BACKGROUND OF THE INVENTION

The present invention relates generally to refuse collection apparatus and, more particularly, to apparatus adapted for the segregation of differing types of refuse, such as recyclable trash materials.

In recent years, increasing efforts and a corresponding public awareness have been directed toward the reclamation and reuse of recyclable refuse and like materials, such as aluminum cans and containers, glass containers and other glass articles, and newspaper and similar paper products, which have traditionally been simply discarded. As is known, considerable cost savings as well as more efficient management and use of natural resources necessary to produce such items may be realized by reclaiming and recycling such items.

Despite the obvious benefits obtained from the reclamation and recycling of items such as those aforementioned, various disadvantages and problems to the individual members of the public have prevented broad-scale public acceptance and participation in organized recycling efforts. Principally, individuals object mostly to the greater space requirements and efforts necessary to segregate and store several differing type of recyclable items, as well as the continuing necessity to collect and dispose of non-recyclable waste and refuse. As will be understood, until the segregated collection of recyclable items can be made less burdensome and more convenient to the individual members of the public, the majority of the public will remain unwilling to participate in organized reclamation programs.

It is accordingly an object of the present invention to provide a refuse collection apparatus specifically designed for segregating and storing recyclable materials as conveniently as, and with no greater space requirements than, conventional trash collections containers.

SUMMARY OF THE INVENTION

Briefly described, the present invention provides an apparatus for the segregated collection of differing types of refuse and the like, such as, in particular, recyclable trash materials. The present collection apparatus basically includes a container body which defines an interior receptacle receiving area and an access opening thereinto, and a plurality of receptacle units each of which defines an interior storage area and a receptacle opening thereinto. The receptacle units are of complimentary shapes and sizes for individually removable disposition in side-by-side relation within the receiving area of the container body with the receptacle openings of the receptacle units generally adjacent one another and the access opening of the container body. According to the present invention, each of the receptacle units has a gripping member or other gripping arrangement provided both adjacent the receptacle opening and at a spacing therefrom to facilitate manual insertion and removal of the receptacle unit into and from the container body.

In one embodiment of the present invention, the container body includes a support arrangement interiorly adjacent the access opening for supporting the receptacle units within the receiving area of the container body, the support arrangement preferably including partitions defining individual section of the receiving area for the individual receptacle units, to provide an annular support surface about each individual section of the receiving area. Each receptacle unit includes an annular lip portion adjacent its receptacle opening for supported engagement with the supporting arrangement and its partitions when the receptacle unit is disposed within the container body.

Preferably, each receptacle unit has a closed end opposite its receptacle opening, with its gripping arrangement including a first handle member on the lip portion and a second handle member on the opposite closed end. The supporting arrangement of the container body and the lip portion of each receptacle unit are compatibly adapted to expose the first handle member of each receptacle unit exteriorly from the container body when the receptacle units are disposed therein.

The collection apparatus may also be provided with a container lid compatibly configured for receipt on the container body about its access opening, the first handle member of each receptacle unit preferably being recessed to avoid interference with the container lid.

According to another embodiment of the present invention, a plurality of the receptacle units are provided for removable side-by-side disposition within the receiving area of the container body and a receptacle tray is provided for removable superposed disposition above the receptacle units partially overlying their receptacle openings to permit access to their interior storage areas so that refuse may be deposited therein without removing the receptacle tray. As in the other embodiment, each receptacle unit is provided with spaced gripping means, preferably in the form of a first handle member adjacent the receptacle opening and a second handle member adjacent its closed end, to facilitate manual insertion and removal of the receptacle units into and from the container body. The receptacle tray similarly is provided with handle portions at opposite sides thereof. The receptacle units and tray are compatibly configured for disposition of the tray within the container body. As in the first embodiment, a container lid may also be provided for receipt on the container body about its access opening for enclosing the receptacle tray and units Preferably, the container body includes a shoulder interiorly adjacent the access opening and the receptacle tray includes a lip portion for supported engagement with the shoulder when the tray is disposed within the container body. A portion may also be provided within the container body for defining an individual section of the receiving area for each receptacle unit.

In another embodiment of the present invention, a partition is provided in the container body dividing its interior receiving area into first and second collection chambers which are open at the access opening into the container body, and a movable cover member is provided for selectively closing the first collection chamber adjacent the access opening of the container body to permit inversion of the container body for dumping of refuse from the second collection chamber without dumping refuse from the first chamber and for selectively opening the first collection chamber for emptying of refuse therefrom when desired. Preferably, a plurality of receptacle units of the afore described type are provided for individually removably side-by-side disposition within the first collection chamber and a receptacle tray may also be supported in superposed disposition on the receptacle units within the first collection chamber. Thus, this embodiment enables recyclable refuse to be collected in segregated fashion within the first collection chamber while the second collection chamber may be utilized for collection of non-recyclable materials A handle arrangement may be provided on the container body compatible for engagement by an automated dumping apparatus of the semi-automatic type for mechanized emptying of the container body, particularly the second collection chamber, the cover member being operative in its closed position to prevent emptying of the first collection chamber. The cover member is preferably pivotably attached to the partition for movement into and out of covering relation to the first collection chamber and is selectively latchable in its closed disposition.

DESCRIPTION OF THE PREFERRED EMBODIMENT

Figure 1:
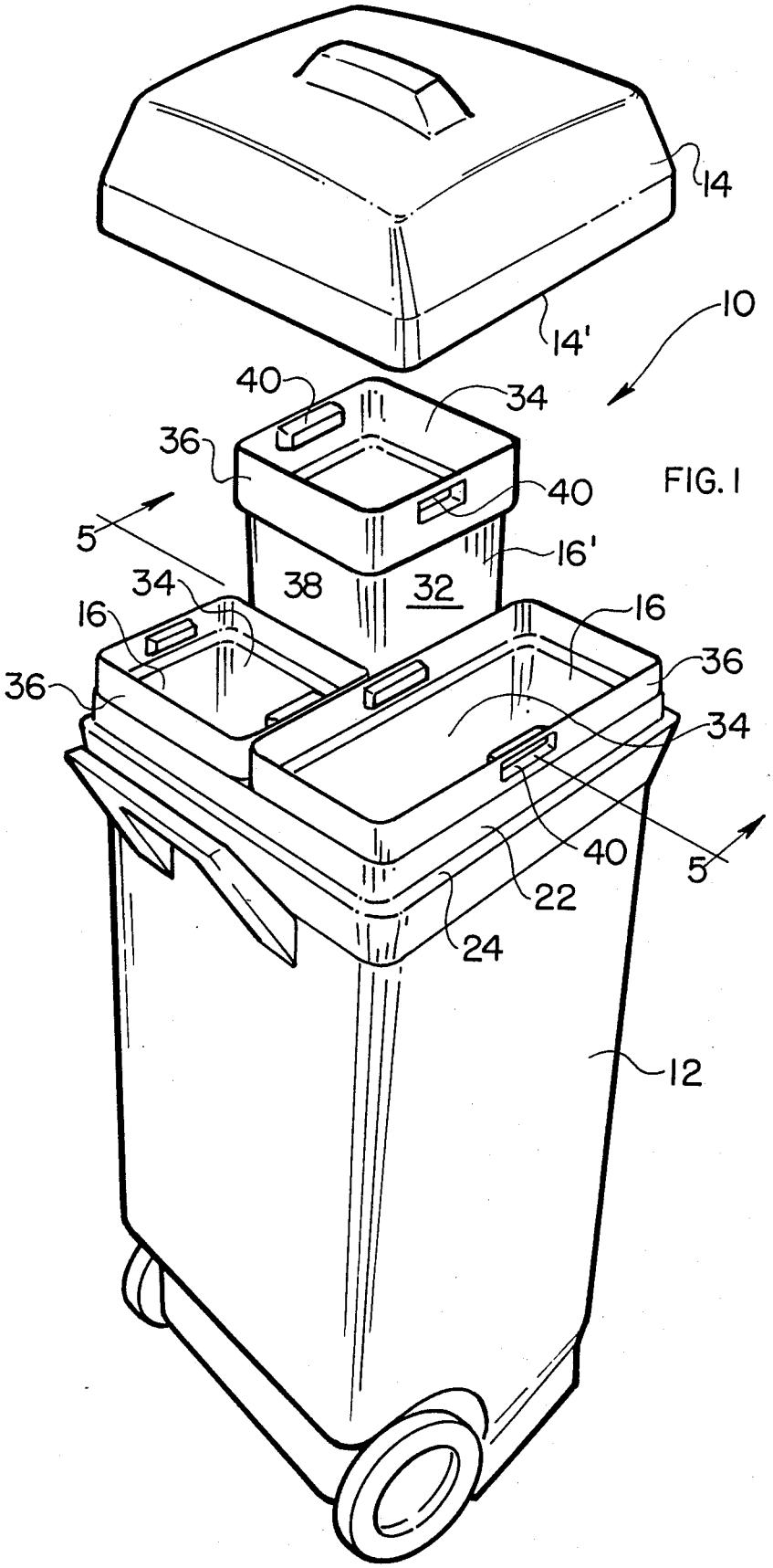
FIG. 1 is a partially exploded perspective view of a segregated refuse collection apparatus according to one preferred embodiment of the present invention.
Figure 2:
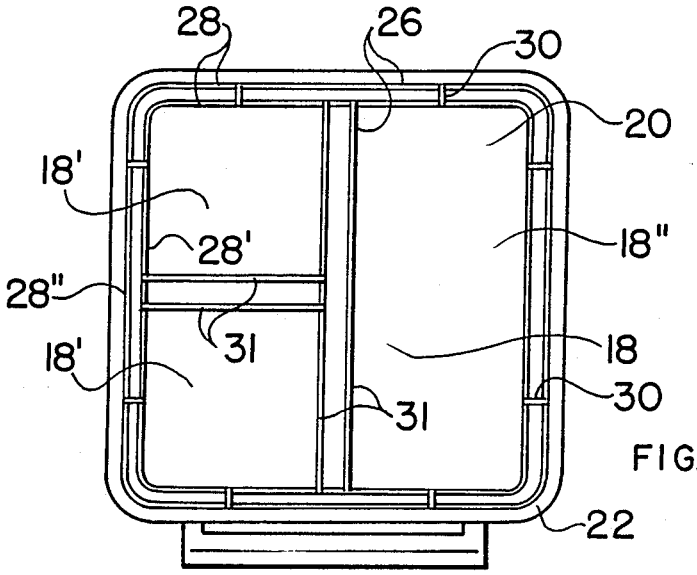
FIG. 2 is a top plan view of the container body of the collection apparatus of FIG. 1, with its receptacle units removed.

Referring now to the accompanying drawings and initially to FIG. 1, an apparatus for segregated collection of differing types of refuse according to tone preferred embodiment of the present invention is shown generally at 10 and basically includes an outer container body 12 with a compatible lid 14, within which is disposed a plurality of individual receptacle units 16 respectively adapted for the segregated collection and storage of differing types of recyclable trash materials or other refuse which require segregation from one another.

The container body 12 may be of any suitable conventional container construction defining an interior receptacle receiving area 18 with an open top 20 or other appropriate access opening thereinto. In the preferred embodiment, a conventional blow-molded plastic trash container, such as the Model 2645/2644 45-gallon wheeled trash container manufactured and sold by Zarn, inc., of Reidsville, North Carolina, the assignee hereof, has been found to be highly suitable for the present invention, although of course those persons skilled in the art will readily recognize that many other conventional trash containers and similar receptacles may be equally well employed. The Zarn Model 2645/2644 container is of a substantially square cross-sectional shape taken laterally through the container body, whereby considerable flexibility in the size and number of the individual inner receptacle units 16 may be realized by forming the units 16 of compatible square and/or rectangular cross-sectional configurations, as more fully explained hereinafter.

The container body 12 is provided with annular rim portion 22 extending about the open top 20 with an outwardly projecting annular ledge surface 24 immediately adjacent the rim portion 22. The rim portion 22 is compatibly configured with the annular depending edge portion 14' of the container lid 14 for snugly receiving the edge portion 14' of the lid 14 snugly about the outer surface of the rim portion 22 in supported engagement on the ledge 24.

The interior area 18 of the container body 12 is fitted with a square wire framework 26 mounted interiorly of the rim portion 22 adjacent the open top 20 of the container body 12, for providing support to the receptacle units 16 when disposed within the container body 12. The wire framework 26 includes an outer mounting portion 28 formed of a pair of substantially square wire units 28',28" of slightly differing side dimensions welded together by several wire cross-members 30. The outer dimension of the outer wire unit 28" of the mounting portion 28 corresponds closely to the interior dimension of the rim portion 22 of the container body 12 to enable the wire framework 26 to be positioned transversely within the interior of the rim portion 22 in closely fitted engagement therewith. The wire framework 26 is further provided with any desired number of transverse pairs of partition wires 31 extending laterally with respect to the mounting wire portion 28 to define any desired number of individual sections 18',18" of the interior area 18 of the container body 12.

Figure 3:
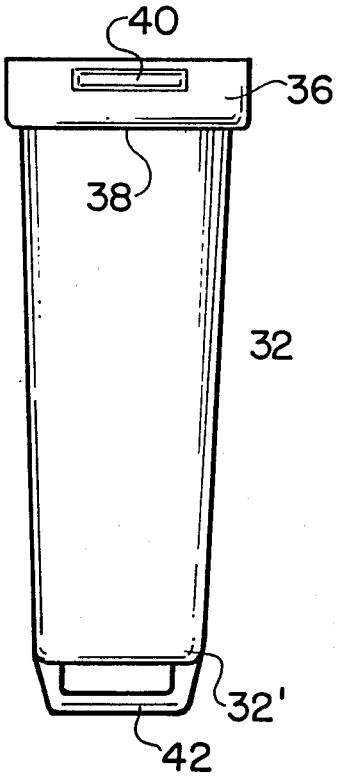
FIG. 3 is a front elevational view of one of the receptacle units of the collection apparatus of FIG. 1.
Figure 4:
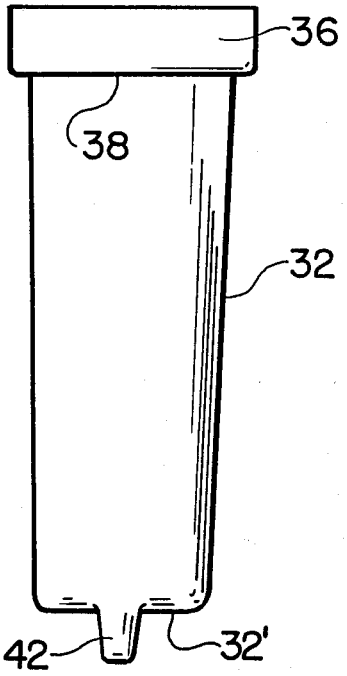
FIG. 4 is a side elevational view of the receptacle unit of FIG. 3.

The particular construction of the individual receptacle units 16 may best be seen and understood with reference to FIGS. 3 and 4. Each of the receptacle units 16 is preferably formed of a plastic material utilizing a conventional blow-molding process similar to that by which the container body 12 is formed. Each receptacle unit 16 basically has a hollow receptacle body 32 closed at one end 32' and having an open top 34 defining a receiving opening into the hollow receptacle interior, each unit 16 being formed of a substantially square or rectangular shape and size complimentary with one another and with the sections 18',18" of the interior area 18 of the container body 12 as defined by the wire framework 26 for individually removable disposition of the units 16 in side-by-side relation within the receiving area 18 of the container body 12. The receptacle body 32 of each unit 16 is formed with an outwardly projecting lip portion 36 extending annularly about the open top 34 of the receptacle body 32 to form a laterally-extending shoulder surface 38 at the underside of the lip portion 36. According to the present invention, each receptacle unit 16 is provided with a pair of handle portions 40 recessed within opposite sides of the lip portion 36 of the unit 16, and another handle 42 projecting outwardly from the closed end 32' of the receptacle body 32.

Figure 5:
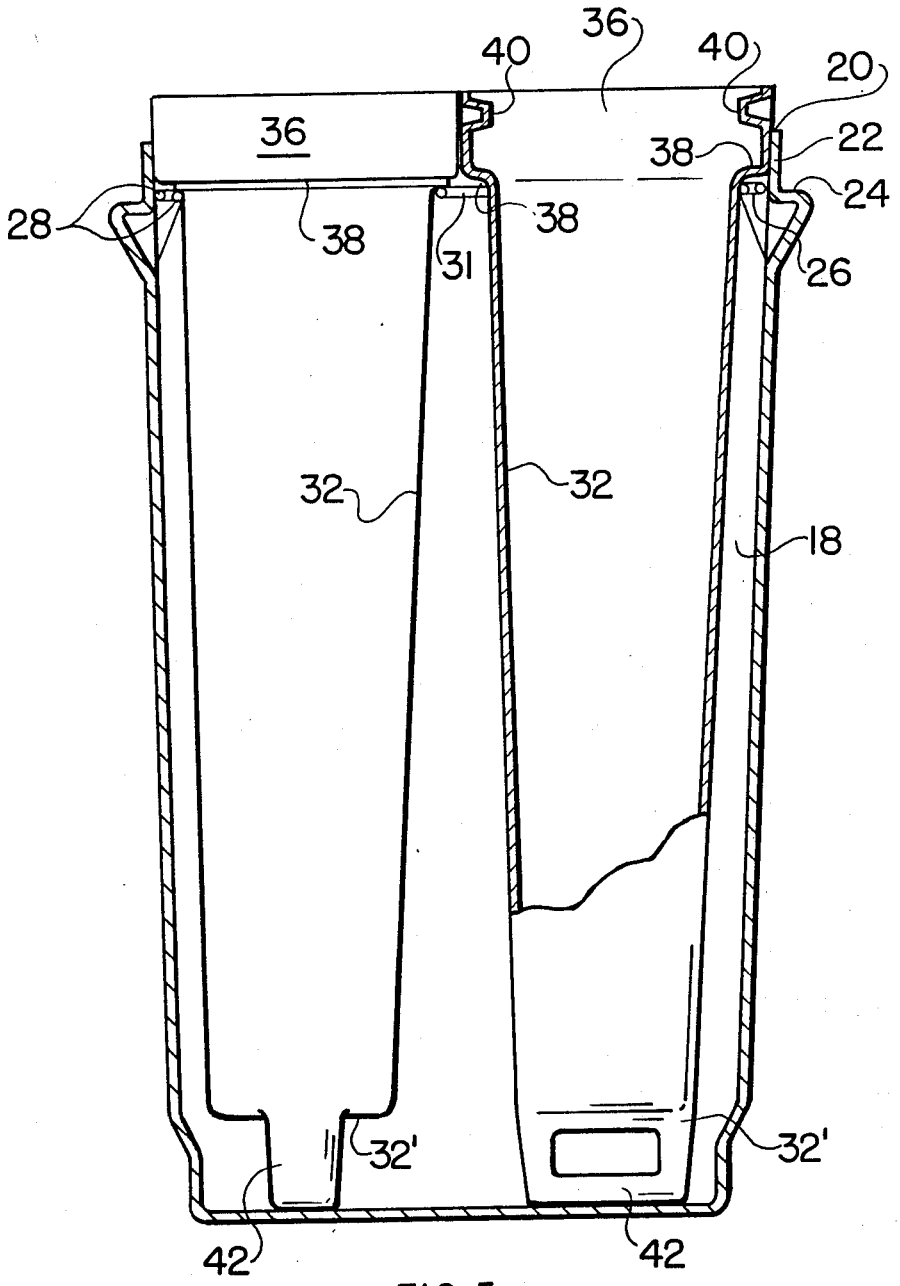
FIG. 5 is a vertical cross-sectional view of the collection apparatus of FIG. 1 taken along line 5—5 thereof.

As will be understood with reference to FIGS. 1 and 5, in the use of the collection apparatus 10, each of the individual receptacle units 16 is adapted to be received within a compatibly defined section 18',18" of the interior area 18 of the container body 12 as defined by its wire framework 26 to position the open top 34 of each receptacle unit 16 generally adjacent the open top 20 of the container body 12 as well as adjacent one another. The mounting portion 28 and the partition members 30 of the wire framework 26 provide an annular support surface about each such section 18',18" on which the annular shoulder surface 38 at the underside of the lip portion 36 of each receptacle unit 16 rests in superposed abutment to securely support the receptacle units 16 within the interior area 18 of the container body 12. In this supported disposition of the receptacle units 16, the lip portion 36 of each unit 16 partially extends upwardly beyond the rim portion 22 of the container body 12 to expose the handle portions 40 of the receptacle unit 16 exteriorly from the container body 12 for ready access and manual removal from the container body 12 when desired. On the other hand, due to the recessed nature of the handle portions 40, the exposed parts of the lip portions 36 of the receptacle units 16 do not project laterally beyond the rim portion 22 of the container body 12, so that the container lid 14 may be placed on and removed from the container body 12 without interference. When removal of any one or more of the receptacle units 16 is desired, the handle portions 40 on the lip portion 36 enable each unit 16 to be manually lifted upwardly from the container body 12, as illustrated by unit 16' in FIG. 1, with the handle 42 at the closed end 32' of the receptacle body 32 in conjunction with the handle portions 40 readily facilitating carrying and inversion of the receptacle unit 16 for dumping of its contents.

As will thus be readily understood, the refuse collection apparatus 10 of the present invention enables a conventional trash receptacle container to be converted to an interiorly-compartmented construction conveniently suitable and adapted for the segregated collection and storage of carious recyclable materials, with substantially no greater effort or inconvenience than is required for the traditional discarding of such refuse or any other waste material. Advantageously, the preferred use of a trash container or square cross-sectional shape in conjunction with inner receptacle units of compatible square and/or rectangular shapes readily enables the present collection apparatus to be easily changeable to selectively provide varying numbers of different compartments. Thus, by way of example, the collection apparatus 10 illustrated in the drawing is equally suited for accepting four of the smaller square cross-sectional units 16, two of the larger rectangular cross-sectional units 16, or the three-unit combination thereof illustrated in the drawings, merely by changing the supporting framework 26. Of course, with larger conventional trash containers, an even greater degree of flexibility may be achieved. Additionally, the depth of the individual units 16 may be selectively varied as necessary or desirable to accommodate the type and weight of refuse to be collected therein. Furthermore, the collection apparatus 10 of the present invention enables significant simplification and greater convenience in the conduct of organized recycling efforts in that the apparatus 10 is well suited for standardized use by municipal and other organized recyclable collection agencies. By way of example, the present apparatus 10 is especially convenient for municipal curb-side collection of recyclable trash in the same manner as other trash materials are traditionally collected. To assist in such system, the individual receptacle units may be coded by color or otherwise to readily identify the type of recyclable contents of each unit. Moreover, the provision of the lower handle 42 at the lower closed end of each individual receptacle unit renders the units incapable of free-standing use apart from the container body 12 which greatly minimizes the possibility of theft or loss of such units, particularly when used in a municipal recycling system.

Figure 6:
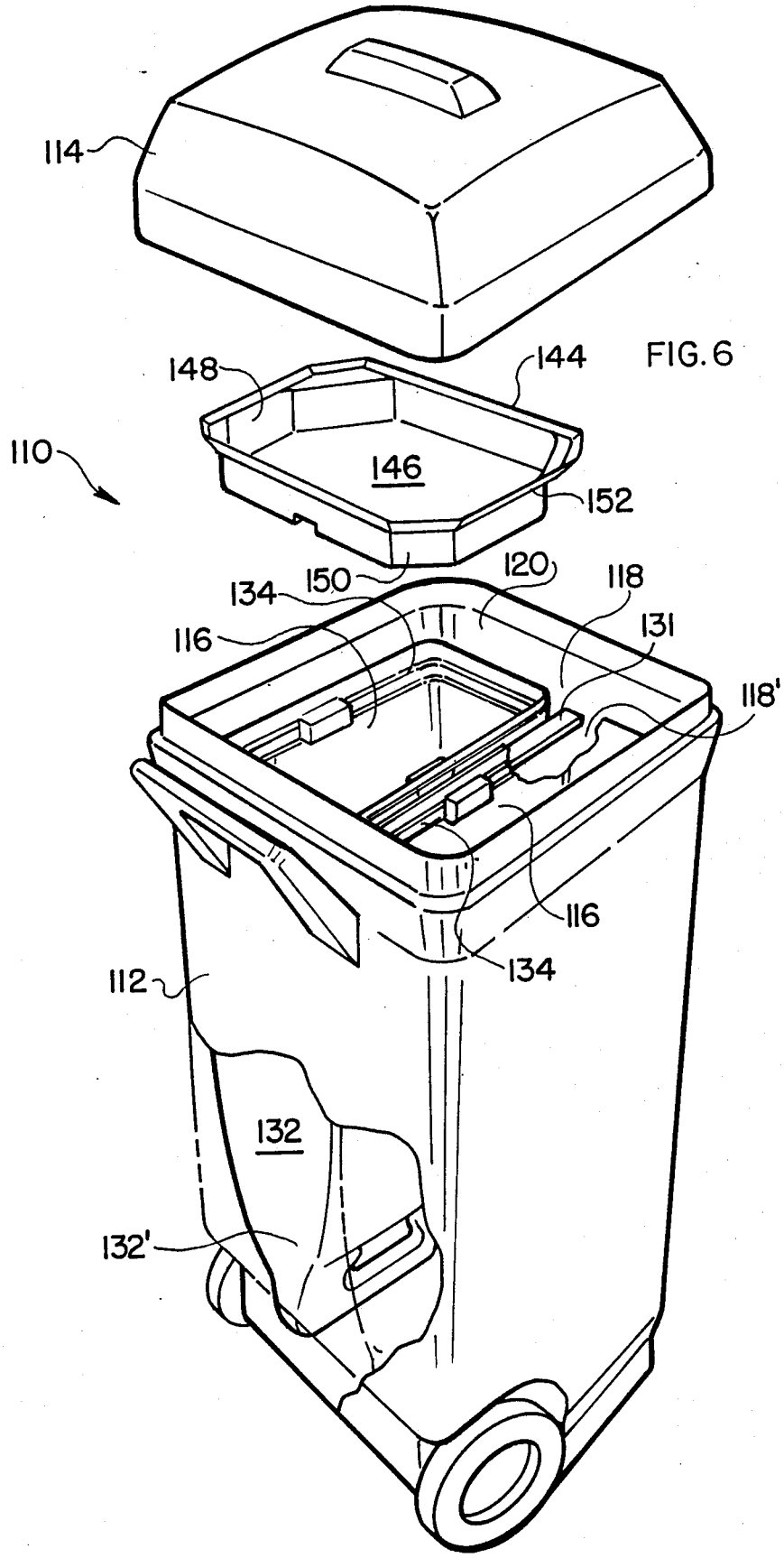
FIG. 6 is a partially exploded perspective view of a segregated refuse collection apparatus according to another preferred embodiment of the present invention.
Figure 7:
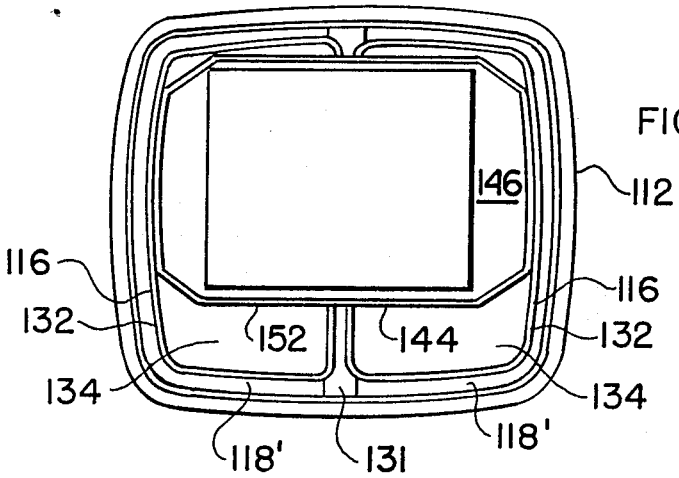
FIG. 7 is a top plan view of the segregated refuse collection apparatus of FIG. 6.
Figure 8:
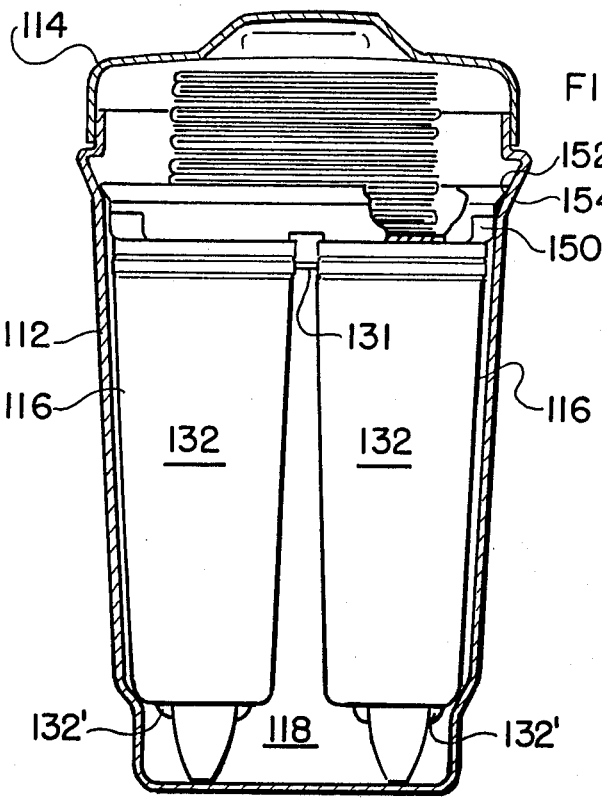
FIG. 8 is a vertical cross-sectional view of the collection apparatus of FIG. 6 taken along line 8—8 thereof.

Referring now to FIGS. 6–8, an alternative preferred embodiment of the collection apparatus of the present invention is shown generally at 110. The refuse collection apparatus 110 utilizes a conventional open-top container body 112 defining an interior receptacle receiving ares 118 of a substantially square cross-section dissected by a partition member 131 extending between opposed facing walls of the body 112 to define two individual rectangular sections 118' of the interior area 118. A compatible lid 114 fits snugly over and about the rim portion 122 of the container body to enclose its interior area 118. As desired, the container body 12 may be the identical conventional wheeled plastic container as utilized in the embodiment of FIGS. 1–5 or any other suitable trash container or receptacle.

The refuse collection apparatus 110 includes a pair of individual receptacle units 116 of a rectangular cross-sectional shape and size compatible with the rectangular sections 118' of the interior area 18 of the container body 12 as defined by the partition member 131 for individual removable disposition of the receptacle units 116 side-by-side within the interior area 118 of the container body 112. The receptacle units 116 are of a substantially similar construction to the units 16 of the first embodiment of FIGS. 1–5, having a hollow receptacle body 132 with an open top 134 and a closed bottom 132' and with a pair of recessed handle portions 140 formed in opposite sides of the receptacle body 132 at its open top 134 and another handle 142 formed at the closed end 132' of the receptacle body 132. However, the receptacle units 116 of this embodiment are of a relatively shorter length between the closed end 132' and the top 134 thereof, so that their tops 134 are disposed at a predetermined depth within the container body 112 below its open top 120 when the receptacle units 116 are placed within the interior area 118 of the container body 112, rather than extending thereabove as in the first described embodiment.

According to this embodiment of the present invention, the refuse collection apparatus 110 also includes a receptacle tray 144 having a relatively flat rectangular bottom wall 146 bordered by a relatively short upstanding peripheral wall 148 defining an open-topped, relatively shallow storage area. Handle recesses 150 are formed in the peripheral wall 148 at its juncture with the bottom wall 146 at each corner of the receptacle tray 144. The tray 144 is thereby provided with a substantially rectangular configuration adapted for disposition within the interior area 118 of the container body 112 to rest on the upper edges of the receptacle units 116 so as to only partially overlie their respective receptacle openings 134. In the manner, access to the interiors of each of the receptacle units 116 as well as the receptacle tray 144 is permitted through the open top 120 of the container body 112 for depositing of refuse in each thereof, without the necessity of removing the receptacle tray 144, as shown in FIG. 7. For additional support of the receptacle tray 144 within the container body 112, the receptacle tray 144 is formed with a lip portion 152 which projects outwardly from the upper edge of the peripheral wall 148 to engage and rest on a compatibly tapered shoulder surface 154 of the interior of the container body 112 when the receptacle tray 144 is rested on the receptacle units 116, as best seen in FIG. 8.

The receptacle tray 144 is advantageously well suited for stacking therein of newspapers, which of course is currently one of the most commonly recycled items. As such the receptacle tray 144 enables a more organized and convenient means for collecting and storing newspapers for recycling than would one of the receptacle units 16 of the first embodiment. At the same time, the receptacle tray 144 does not completely cover the open tops 134 to the receptacle units 116 so as not to inhibit their use for collecting other common recyclable materials, such as glass and aluminum items. Thus, this embodiment of the present invention provides the unique capability of conveniently segregating and collecting the three classes of items most commonly recycled under current recycling systems, namely, newspaper, glass and aluminum. Otherwise, this embodiment of the present collection apparatus provides all of the same aforementioned advantages of the first embodiment of this invention.

Figure 9:
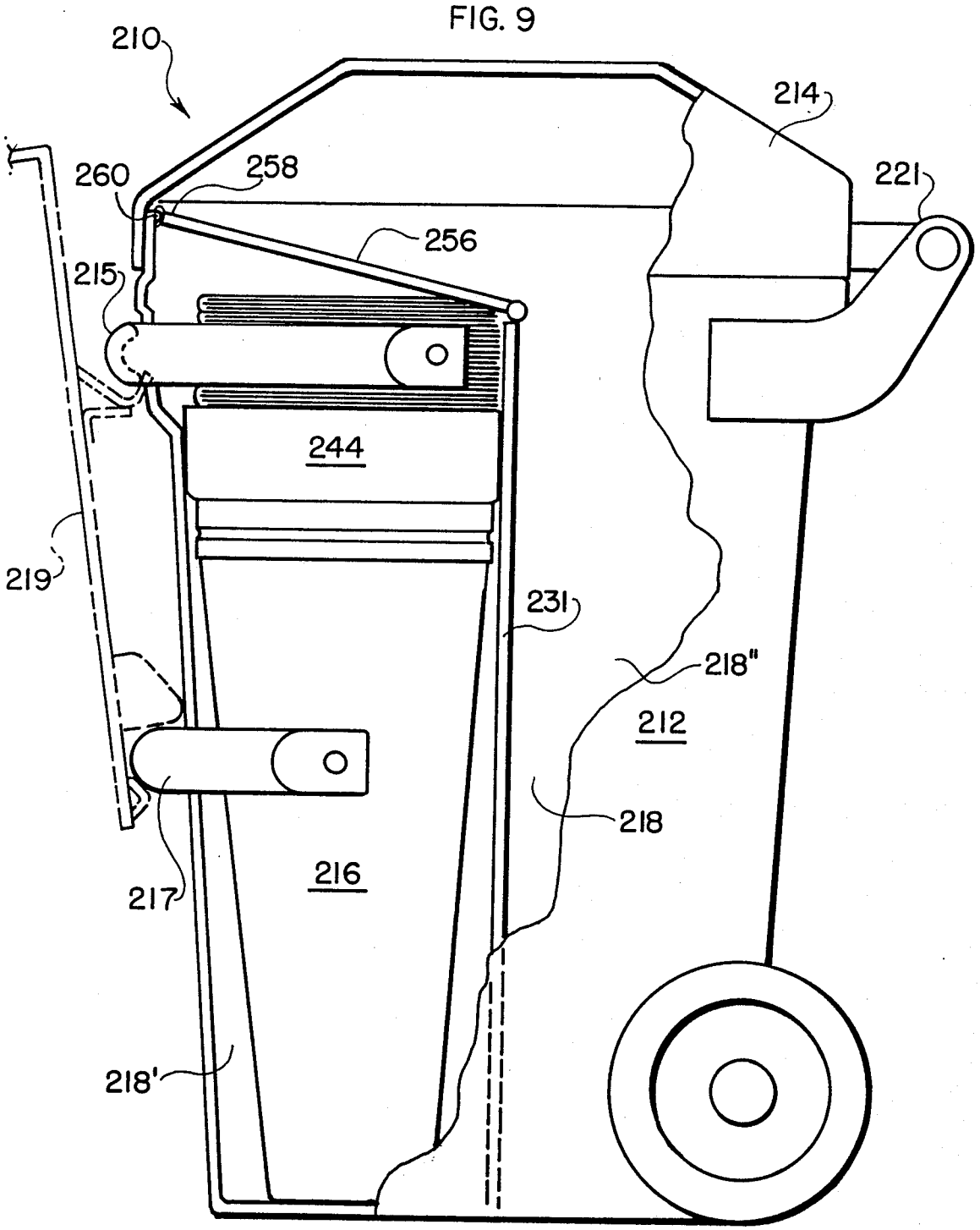
FIG. 9 is a side elevational view, partially in vertical cross-section, of a segregated refuse collection apparatus according to another preferred embodiment of the present invention.
Figure 10:
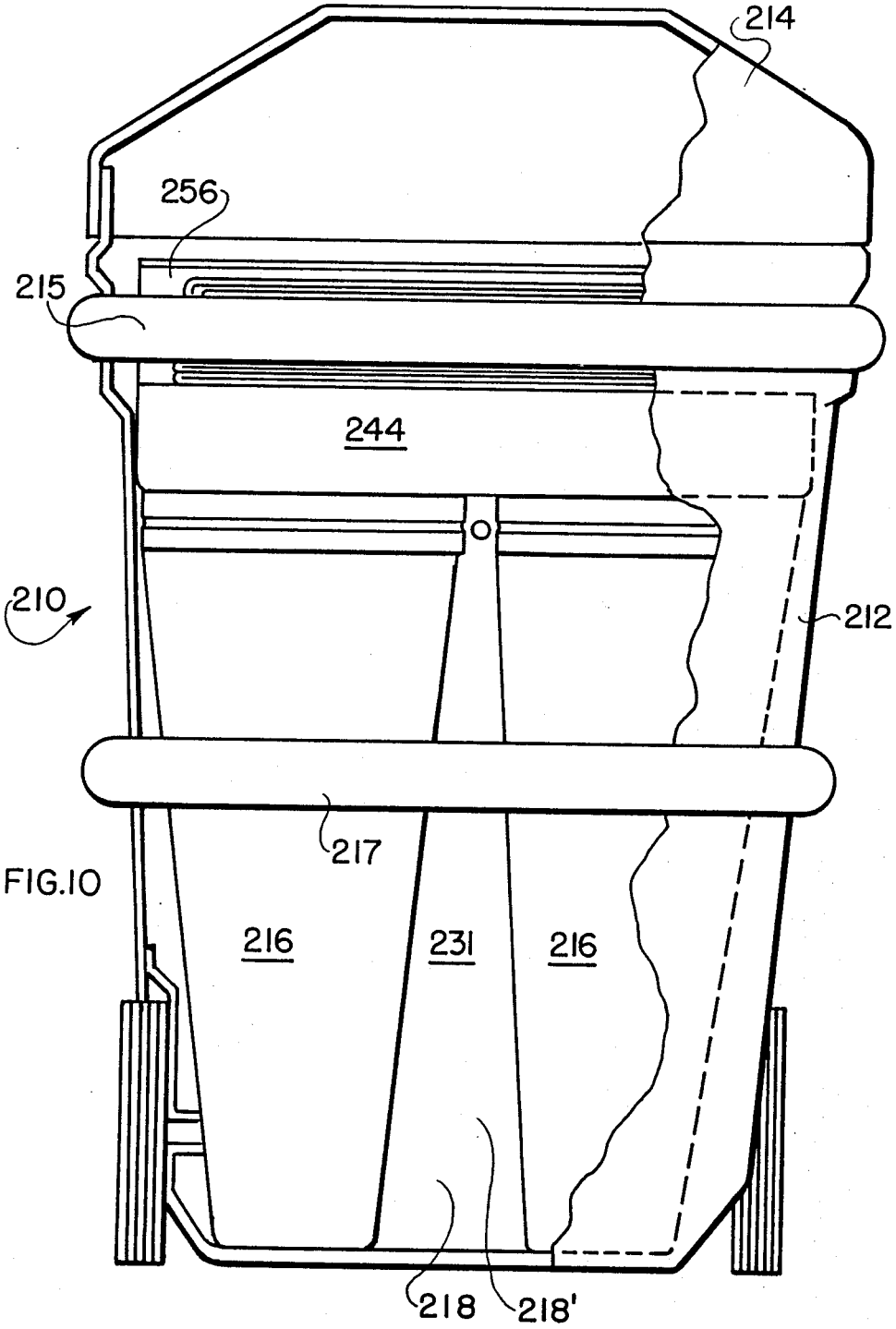
FIG. 10 is a front elevation view, partially in vertical cross-section, of the collection apparatus of FIG. 9.

Referring now to FIGS. 9 and 10, a third preferred embodiment of the segregated refuse collection apparatus of the present invention is shown generally at 210. The refuse collection apparatus 210 utilizes a wheeled open-topped container body 212 having upper and lower horizontally disposed lifter handles 215, 217 arranged for compatible engagement by a conventional automated dumping apparatus of the semi-automatic type, representively indicated at 219. A representative example of such a conventional semi-automatic dumping apparatus is disclosed in Wyman et al U.S. Pat. No. 4,479,751 and another representative example is the TUCK-AWAY® brand dumping unit manufactured and sold by Perkins Manufacturing Company of Le Grange, Illinois. Representative examples of compatible trash containers are the various models of ROLL-A-WASTE® plastic trash containers manufactured and sold by Zarn, Inc., of Reidsville, North Carolina, the assignee hereof. The container body 212 is open at its upper end and defines an interior receiving area 218 of essentially square cross-section with a manual handle assembly 221 affixed at opposite sides to the upper end of the container body 212 and a lid 223 pivotably affixed to the handle assembly 221 for movement into and out of snug engagement about the open upper end of the container body 212.

The refuse collection apparatus 210 includes an interior partition wall 231 affixed to and extending in vertical disposition transversely between opposite sidewalls of the container body 212 to divide the interior area 218 into two collection chambers 218', 218'' of generally equivalent rectangular cross-sectional areas and generally equivalent volumes. The collection apparatus 210 further includes a pair of individual receptacle units 216 of a square cross-sectional shape and size compatible with the rectangular cross-section of the collection chamber 218' of the container body 218 for individual removable disposition of the receptacle unit 216 side-by-side within the collection chamber 218'. The receptacle units 216 may be of a substantial similar construction to the units 116 of the above-described embodiment of FIGS. 6–8. In addition, a rectangular receptacle tray 244 defining an open-topped, relatively shallow storage area is provided for removable disposition within the collection chamber 218' to rest on the upper edges of the receptacle units 216, the tray 244 preferably being of a comparable construction to the above-described tray 144 of the embodiment of FIGS. 6–8. A substantially rectangular cover member 266 is pivotably attached along one length-wise edge thereof to the upwardly facing edge of the partition wall 231 within the container body 212 for pivotal movement into and out of covering relation to the collection chamber 218'. The opposite longitudinal edge of the cover member 266 and the front wall of the container body 212 are formed with mating latch members only representatively indicated at 258, 260 which may be of any suitable conventional construction. In this manner, the cover member 266 may be selectively latched in a closed position covering and enclosing the collection chamber 218' and, likewise, may be selectively unlatched for pivotal movement of the cover member 256 into an open position permitting access into the collection chamber 218'.

As will best be understood, the refuse collection apparatus 210 is advantageously adapted for the simultaneous collection of both recyclable materials, such as aluminum items, glass items and newspapers, in a segregated fashion in the collection chamber 218' utilizing the receptacle units 216 and the receptacle tray 244 in the same manner as in the embodiment of FIGS. 6–8, while the collection chamber 218'' may be utilized for collection and storage of other non-recyclable refuse for which less collection volume will normally be required when recyclable refuse, which otherwise would be discarded with non-recyclable refuse, is systematically segregated. Further, the selectively latchable pivoted cover member 256 in conjunction with the arrangement of the receptacle tray 244 in superposed disposition resting on the upper edges of the receptacle units 216 uniquely permits the collection apparatus 210 to be utilized in conventional fashion as part of a semi-automatic trash collection system for automated collection of non-recyclable trash without disturbing the recyclable materials segregated within the collection chamber 218'. Specifically, as is known, semi-automatic trash collection systems utilize specially constructed trash containers, such as the container body 212 having upper and lower lifter bars by which the container may be mounted by collection personnel onto a compatible automated dumping apparatus on a collection vehicle for mechanized inversion of the trash container by its lifter bars to empty its contents into the collection vehicle. With the refuse collection apparatus 210, the cover member 256 when latched in its closed position serves to retain newspapers or the like in stacked disposition on the receptacle tray 244 which in turn serves to retain other recyclable materials collected within the receptacle units 216, even when the container body 212 is inverted for dumping of non-recyclable refuse from the collection chamber 218'', while alternatively the cover member 256 may be readily unlatched and opened for easy manual access into the collection chamber 218' to remove the segregated recyclable materials collected within the receptacle units units and tray 216, 244. Advantageously, therefore, the refuse collection apparatus 210 accommodates both organized recycling programs as well as automated collection of non-recyclable refuse without increasing the overall space and storage requirements for such refuse. Further, the interior partition wall 231 with the cover member 256 and the receptacle units and tray 216, 244 may readily be retrofitted into existing trash containers of the semi-automatic type, enabling municipalities and other refuse collection agencies already utilizing such an automated trash collection system to easily adopt an organized recycling program at minimal additional cost and with minimal change in established collection procedures.

It will therefore be readily understood by those persons skilled in the art that the present invention is susceptible of a broad utility and application. Many embodiments and adaptations of the present invention other than those herein described, as well as many variations, modifications and equivalent arrangements will be apparent from or reasonably suggested by the present invention and the foregoing description thereof, without departing from the substance or scope of the present invention. Accordingly, while the present invention has been described herein in detail in relation to its preferred embodiment, it is to be understood that this disclosure is only illustrative and exemplary of the present invention and is made merely for purposes of providing a full and enabling disclosure of the invention. The foregoing disclosure is not intended or to be construed to limit the present invention or otherwise to exclude any such other embodiment, adaptations, variations, modifications and equivalent arrangements, the present invention being limited only by the claims appended hereto and the equivalents thereof.

What is claimed is:

1. Apparatus for segregated collection of differing types of refuse and the like such as recyclable trash materials, comprising:

a container body defining an interior receptacle receiving area and an access opening thereinto; and a plurality of receptacle units each defining an interior storage area, a receptacle opening thereinto, and a closed end generally opposite said receptacle opening, said receptacle units being of complimentary shapes and sizes for individually removable disposition in side-by-side relation within said receiving area of said container body with said receptacle openings of said receptacle units generally adjacent one another and said access opening of said container body;

each said receptacle unit having first gripping means adjacent said receptacle opening at second gripping means at said opposite closed end for manual insertion and removal of said receptacle unit into and from said container body and for easy inversion of said receptacle unit for discharging its contents, said second gripping means being configured to render said recepticle unit incapable of free standing disposition on said opposite closed end to minimize possible theft or loss thereof.

2. Apparatus for segregated collection of differing types of refuse and the like according to claim 1 and characterized further in that said first gripping means of each said receptacle unit includes first handle means adjacent said receptacle opening and said second gripping means of each said receptacle unit includes second handle means adjacent said opposite closed end.

3. Apparatus for segregated collection of differing types of refuse and the like according to claim 2 and characterized further in that each said receptacle unit and said container body are compatibly adapted to expose said first handle means of said receptacle unit exteriorly from said container body when said receptacle unit is disposed therein.

4. Apparatus for segregated collection of differing types of refuse and the like according to claim 3 and characterized further by a container lid compatibly configured for receipt on said container body about its said access opening, said first handle means of each said receptacle unit being recessed avoid interference with said container lid.

5. Apparatus for segregated collection of differing types of refuse and the like according to claim 1 and characterized further in that said container body including means interiorly adjacent said access opening for supporting said receptacle units within said receiving area of said container body and each said receptacle unit includes a lip portion adjacent its said receptacle opening for supported engagement with said supporting means when said receptacle unit is disposed within said container body.

6. Apparatus for segregated collection of differing types of refuse and the like according to claim 5 and characterized further in that said supporting means includes partition means defining an individual section of said receiving area for each said receptacle unit.

7. Apparatus for segregated collection of differing types of refuse and the like according to claim 6 and characterized further in that said supporting means defines an annular support surface about each said section of said receiving area and said lip portion of each said receptacle unit extends annularly thereabout.

8. Apparatus for segregated collection of differing types of refuse and the like according to claim 5 and characterized further in that said first gripping means of each said receptacle unit includes first handle means on said lip portion and said second gripping means of each said receptacle unit includes second handle means on said opposite closed end.

9. Apparatus for segregated collection of differing types of refuse and the like according to claim 8 and characterized further in that said supporting means of said container body and said lip portion of each said receptacle unit are compatibly adapted to expose said first handle means of said receptacle unit exteriorly from said container body when said receptacle unit is disposed therein.

10. Apparatus for segregated collection of differing types of refuse and the like according to claim 9 and characterized further by a container lid compatibly configured for receipt on said container body about its said access opening, said first handle means of each said receptacle unit being recessed to avoid interference with said container lid.

11. Apparatus for segregated collection of differing types of refuse and the like according to claim 1 and characterized further by a receptacle tray for removable superposed disposition above said receptacle units partially overlying their said receptacle openings for access to said interior storage areas of said receptacle units for depositing refuse therein without removing said receptacle tray.

12. Apparatus for segregated collection of differing types of refuse and the like according to claim 11 and characterized further in that said receptacle units and said receptacle tray are compatibly configured for disposition of said receptacle tray within said container body.

13. Apparatus for segregated collection of differing types of refuse and the like according to claim 11 and characterized further in that said receptacle tray includes handle means at opposite sides thereof.

14. Apparatus for segregated collection of differing types of refuse and the like according to claim 11 and characterized further in that said container body includes shoulder means interiorly adjacent said access opening and said receptacle tray includes a lip portion for supported engagement with said shoulder means when said receptacle tray is disposed within said container body.

15. Apparatus for segregated collection of differing types of refuse and the like, comprising;

a container body defining an interior receiving area and an access opening thereinto;

a partition in said container body dividing its said interior receiving area into first and second collection chambers open at said access opening; and a cover member movably mounted to said partition for selectively closing said first collection chamber adjacent said access opening of said container body while opening said second collection chamber to permit inversion of said container body for dumping of refuse from said second collection chamber without dumping of refuse from said first collection chamber and for selectively opening said first collection chamber for emptying of refuse therefrom; and characterized further by a plurality of receptacle units each defining an interior storage area and a receptacle opening thereinto, said receptacle units being of complementary shapes and sizes for individually removable disposition in side-by-side relation within said first collection chamber of said container body with said receptacle openings of said receptacle units generally adjacent one another and access opening of said container body

16. Apparatus for segregated collection of differing types of refuse and the like according to claim 15 and characterized further by a receptacle tray for removable superposed disposition above said receptacle units.

17. Apparatus for segregated collection of differing types of refuse and the like according to claim 16 and characterized further in that said receptacle tray is adapted to be supported by said receptacle units.

18. Apparatus for segregated collection of differing types of refuse and the like according to claim 17 and characterized further in that said receptacle units and said receptacle tray are compatibly configured for disposition of said receptacle tray within said first collection chamber.

19. Apparatus for segregated collection of differing types of refuse and the like according to claim 15 and characterized further by means for selectively latching said cover member in disposition closing said first collection chamber of said container body.

20. Apparatus for segregated collection of differing types of refuse and the like according to claim 15 and characterized further in that said cover member is pivotably attached to said partition for movement into and out of covering relation to said first collection chamber.

21. Apparatus for segregated collection of differing types of refuse and the like according to claim 15 and characterized further in that said container body includes handle means compatible for engagement by an automated dumping apparatus of semi-automatic type for mechanized emptying of said container body, said cover member being operative in its position closing said first collection chamber to prevent emptying thereof.

* * * * *

UNITED STATES PATENT AND TRADEMARK OFFICE

CERTIFICATE OF CORRECTION

PATENT NO. : 4,878,592

DATED : November 7, 1989

INVENTOR(S) : Norman C. Lee

It is certified that error appears in the above-identified patent and that said Letters Patent is hereby corrected as shown below:

Column 1, Line 39, reads "collections" but should read -- collection --.

Column 2, Line 43, after "units" add -- . --.

Column 3, Lines 3-4, after "materials" add -- . --.

Column 3, Line 40, reads "elevation" but should read -- elevational --.

Column 3, Line 47, reads "tone" but should read -- one --.

Column 3, Line 63, reads "inc." but should read -- Inc. --.

Column 5, Line 36, reads "carious" but should read -- various --.

Column 6, Line 12, reads "ares" but should read -- area --.

Column 6, Line 58, reads "the" but should read -- this --.

Column 8, Line 58, after "units" delete -- units --.

Column 9, Line 42, reads "at" but should read -- and --.

Column 10, Line 2, after "recessed" add -- to --.

Column 10, Lines 6-7, reads "including" but should read -- includes --.

UNITED STATES PATENT AND TRADEMARK OFFICE

CERTIFICATE OF CORRECTION

PATENT NO. : 4,878,592

DATED : November 7, 1989

INVENTOR(S) : Norman C. Lee

It is certified that error appears in the above-identified patent and that said Letters Patent is hereby corrected as shown below:

Column 11, Line 30, after "and" add -- said --.

Column 11, Line 30, after "body" add -- . --.

Signed and Sealed this

Twentieth Day of October, 1992

*Attest:*

DOUGLAS B. COMER

*Attesting Officer*

*Acting Commissioner of Patents and Trademarks*